US005752727A

United States Patent [19]

Zues et al.

[11] Patent Number: 5,752,727

[45] Date of Patent: May 19, 1998

[54] DRIVE-ROD TYPE DRIVE MECHANISM

[75] Inventors: Christian Zues, Stilff; Heinz-Eckhard Engel, Glurns, both of Italy

[73] Assignee: Hoppe AG, St. Martin, Italy

[21] Appl. No.: 694,441

[22] Filed: Aug. 12, 1996

[30] Foreign Application Priority Data

Aug. 17, 1995 [DE] Germany ..... 295 13 227 U

[51] Int. Cl.[6] ..... E05C 9/10

[52] U.S. Cl. ..... 292/34; 292/140; 292/143

[58] Field of Search ..... 292/336.3, 34, 292/37, 140, 143, DIG. 21

[56] References Cited

U.S. PATENT DOCUMENTS

| | | | |
|---|---|---|---|
| 266,799 | 10/1882 | Felsburg | 292/37 |
| 699,334 | 5/1902 | Lyon | 292/37 |
| 1,670,277 | 5/1928 | Albach | 292/37 X |
| 4,790,583 | 12/1988 | Tonsmann et al. | 292/336.3 |
| 5,197,771 | 3/1993 | Kaup et al. | 292/DIG. 21 X |
| 5,318,333 | 6/1994 | Dreifert | 292/336.3 |
| 5,524,942 | 6/1996 | Fleming | 292/34 |

FOREIGN PATENT DOCUMENTS

| | | | |
|---|---|---|---|
| 51446 | 12/1911 | Austria | 292/34 |
| 356772 | 3/1990 | European Pat. Off. | 292/34 |
| 1539041 | 8/1968 | France | 292/37 |
| 352419 | 4/1922 | Germany | 292/140 |
| 2909299 | 9/1980 | Germany | 292/336.3 |

*Primary Examiner*—Rodney M. Lindsey

*Attorney, Agent, or Firm*—Lowe, Price, LeBlanc & Becker

[57] ABSTRACT

A drive type operating mechanism for locking gates, windows, double-wing doors and the like includes push rods which are movable longitudinally in opposite directions to effect locking of the upper and lower ends of the door with the surrounding framework. The mechanism is connected for actuation by a lever handle through an arrangement of follower elements that are slidable supported in a lock case. A nut sleeve follower which is rotatable by the lever handle has one claw which cooperates with a groove in one longitudinally movable follower, and a second claw which cooperates with a transversely slidable intermediate follower which in turn cooperates with a groove in the second longitudinal follower, this arrangement ensuring that upon rotation of the handle the followers (and hence the locking bolts) move in opposite directions. A lock mechanism ensures that the longitudinally movable followers are not inadvertently moved from their end limiting positions.

19 Claims, 2 Drawing Sheets

DRIVE-ROD TYPE DRIVE MECHANISM

BACKGROUND OF THE INVENTION a) Field of the Invention

The present invention relates to a drive-rod type mechanism for double-wing doors, gates, windows and the like.

b) Description of the Prior Art

Double-wing doors have a movable wing including door fittings, latch and bolt, and a so-called stationary wing which fulfills the stop and striking-plate function for the movable wing. To reliably arrest the stationary wing in the closing position, two edge bolts with individually extensible locking bolts that engage suitable recesses in the upper frame lintel and the floor, respectively, upon shifting of a lever are mounted, for example, on the upper and lower rebate ends of the stationary wing. The stationary wing can only be unlocked after the movable wing has been opened, the levers being only reachable by way of uncomfortable stooping and stretching, which may especially pose problems in the case of high doors.

Furthermore, there are known door drive bolts comprising two push rods embedded in the door rebate of the stationary wing, which are oppositely operated by means of a turn or tilt lever arranged at handle height on the door leaf and by means of a drive mechanism possibly integrated into the door leaf. The ends of these push rods which are positioned within the drive mechanism are formed as racks and interact via toothed gearing with the lock nut, so that the locking bolts are simultaneously retracted and extended at the outer ends of the push rods by operating the lever. This structure is not only very troublesome, but also especially prone to wear. Moreover, positioning errors of the push rods may easily occur when the drive mechanism is being installed, which may impair the closing function of the locking bolts.

It is an object of the present invention to provide a push-rod type drive mechanism of a simple and robust construction. Moreover, easy assembly and reliable handling should be ensured.

SUMMARY OF THE INVENTION

The invention provides a drive-bolt drive mechanism for doors, gates, windows, or the like, comprising: a lock case; at least one handle lever pivotably supported in a lock nut in said case; and two oppositely driven push rods which are supported in a longitudinally movable manner in said case; wherein said push rods are coupled for actuation by said handle lever via follower elements that are movably supported in said case.

This permits a simple and robust structure of the drive-bolt drive mechanism, since the movable parts are reduced to a few elements that can moreover be produced at low cost. When the handle lever is operated, the push rods are reliably brought into their end positions via the follower elements, so that the door or gate wing can be opened, or locked in a closing position, as desired. The drive mechanism can be mounted easily because the drive parts mesh with one another with an accurate fit; positioning errors are effectively avoided.

The follower elements are preferably longitudinal slides guided in longitudinal grooves and transverse slides guided in transverse grooves, with one longitudinal slide being in direct engagement and a second longitudinal slide in indirect engagement with a pivotably supported follower via a transverse slide follower coupled to move in response to pivotal movement of the handle. Rotational movement which is exerted on the handle lever is converted by simple means via the follower into linear movement of the transverse and longitudinal slides. The motion direction of the upper longitudinal slide, which is coupled via the transverse slide, is automatically reversed compared to that of the lower slide, so that the longitudinal slides perform opposite movements.

The lock nut preferably comprises a projecting lateral follower pin which engages into a free-running arcuate recess portion of the follower. The follower is formed as a nut sleeve and encloses the lock nut, so that the nut sleeve can be pivoted by simply operating the nut via the handle. After each operation the free-running arcuate recess portion enables the handle to be returned into its center position.

The nut sleeve may comprise a claw which engages into a groove of the lower longitudinal slide. Rotational movement of the nut sleeve is thereby converted via the claw and the groove into longitudinal movement of the longitudinal slide. To achieve an optimum operational path of the slide, the groove is oriented at an angle oblique to the motional direction of the longitudinal slide (to which one of the push rods is coupled).

Preferably there is in the nut sleeve a second claw which engages in a groove of the transverse slide supported in a transversely movable manner above the lock nut, this groove being oriented in a direction transverse to the motional direction of the transverse slide. The transverse slide has a slide nose which engages in a groove of the upper longitudinal slide, which groove is oriented at an angle, preferably about 45°, oblique to the motion direction of that slide. Rotational movement of the nut sleeve creates linear movement of the transverse slide which, in turn, is converted into longitudinal movement of the upper longitudinal slide perpendicular thereto, the second push rod being coupled to the upper longitudinal slide.

The grooves may be made straight, so that the frictional resistance is as small as possible within the grooves. To prevent an unauthorized operation of the push rods however, the grooves may be formed as curved paths.

The push rods and/or one of the follower elements are lockable in their end or limiting positions so that they remain retracted when the door or the gate is being pivoted, and are not extended inadvertently.

The push rods can be locked by means of a lock bolt in the closing position, so that an operation of the push rods by unauthorized persons can be prevented. The bolt can be operated via a closing cylinder and can be arrested in its end positions.

BRIEF DESCRIPTION OF THE DRAWINGS

Other features, details and advantages of the invention will become apparent from the wording of the claims and from the following description of preferred embodiments thereof taken in conjunction with the drawings, in which:

DESCRIPTION OF THE PREFERRED EMBODIMENTS

Figure 1:
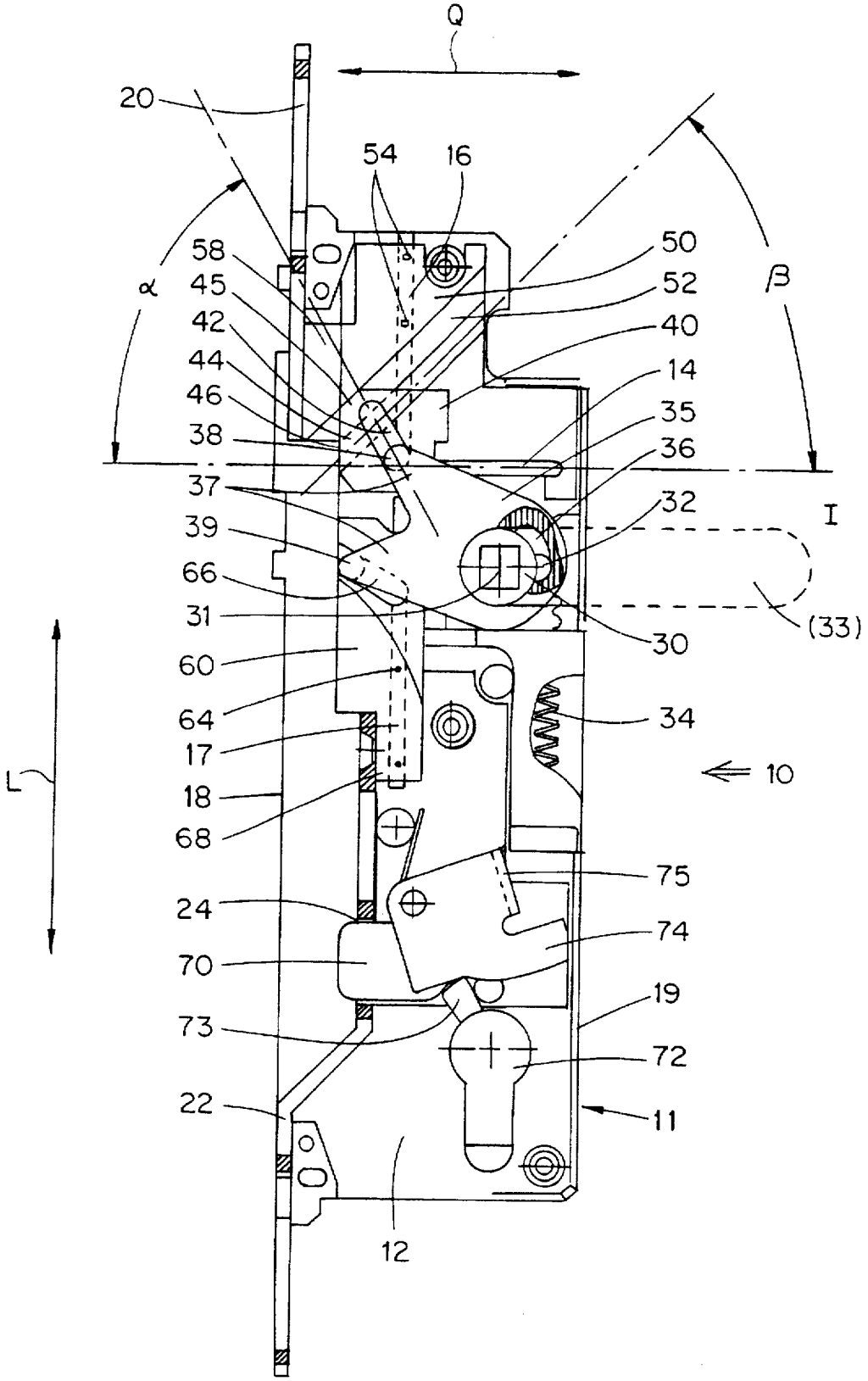
FIG. 1 is a lateral view of a drive-rod type drive mechanism, partly in cross-section, with extended push rods.

The drive-rod type drive mechanism 10 shown in FIG. 1 comprises a lock case 11 including a bottom part 12 and a cover (not shown), a cuff rail (also not shown) which is secured to the front plate 18 of the lock case, an upper push rod 20 and a lower push rod 22 which are supported in a longitudinally movable manner behind the cuff rail.

A lock nut 30 is rotatably supported between the bottom part 12 and the cover of the lock case 11 and is laterally provided with a follower pin 32 and serves to receive a handle 33 (shown only in broken line in FIGS. 1 and 2) which is held by a restoring spring 34 in a horizontal center position I (FIG. 1). A follower 35 in the form of a nut sleeve is rotatably supported around nut 30. The nut sleeve has an arcuate recessed portion 36 concentrically arranged relative to the rotational axis 31, and engaged by the follower pin 32. Two extension arms 37 having ends each respectively provided with a claw 38, 39 are attached to the nut sleeve 35 projecting in a direction opposite to the free-running recessed portion 36.

A transverse slide 40 which is supported in a transversely movable manner by pins (not shown) in a transverse groove 14 in the bottom 12 of the lock case 11 is arranged above the lock nut 30. At its upper side the transverse slide 40 has a groove 42 which is embedded at an angle α (FIG. 1) in a direction oblique to the transverse direction of motion Q and which is engaged by the upper claw 38 of the nut sleeve 35. A guide groove 44 which is obliquely oriented by an angle β (FIG. 1) is provided at the bottom side of the transverse slide 40 with a lateral edge formed as a slide nose 45. The latter is in engagement with an upper longitudinal slide 50 which comprises a slide groove 52 extending parallel to the guide groove 44. The slide 50 is guided in a longitudinally displaceable manner by pins 54 thereon engaging the bottom 12 of lock case 11 in a longitudinal groove 16 oriented in a direction perpendicular to the transverse groove 14.

A lower longitudinal slide 60 is supported in a longitudinally displaceable manner by pins 64 received in a longitudinal groove 17 in the bottom 12 of the lock case 11, and is positioned below the lock nut 30. At its upper side the longitudinal slide 60 has a groove 66 which is embedded at an angle δ (FIG. 2) in a direction oblique to the motional direction L and is engaged by the lower claw 39 of the nut sleeve 35.

At their upper and lower ends, the longitudinal slides 50, 60 have attachment pieces 58, 68 to which the push rods 20, 22 are secured. At their ends (not shown) the push rods carry locking bolts (also not visible) that engage into suitable bushings (not shown) in the upper frame lintel and in the floor to lock the door, gate or window wing.

The length of the extension arms 37 as well as the angles α, δ and the lengths of grooves 42, 66 are chosen such that both longitudinal slides 50, 60 and thus both push rods 20, 22 are adjusted in opposite directions by equal amounts upon turning the nut sleeve 35. Angle β is preferably 45°.

FIG. 1 shows the drive-rod type drive mechanism 10 in the closed position. Handle 33 is in its center position I and the follower pin 32 of the lock nut 30 rests on the lower end of the free-running portion 36. The transverse slide 40 abuts at its front end face 46 on the lock case front 18, thereby forming a stop for the movement of handle 33 (and for the longitudinal slides 50, 60 which are also shown in their respective bottom and top end positions). The door or window wing is thus locked.

When the handle 33 is rotated against the restoring force of the spring 34 downwards into the position designated by II (see FIG. 2), the nut sleeve 35 is pivoted via the follower pin 32 of nut 30 and the transverse slide 40 is moved by the claw 38 along transverse groove 14 to the right. At the same time, the slide nose 45 moves within the slide groove 52 of the upper longitudinal slide 50 (which is obliquely arranged at 45°) and pushes the longitudinal slide 50 along its longitudinal groove 16 downwards. The upper push rod 20 is thus retracted. At the same time, the second claw 39 of the nut sleeve 35 pulls the lower longitudinal slide 60 along its longitudinal groove 17 upwards, so that the lower push rod 22 is also retracted.

The transverse slide 40 now abuts with its rear end face 47 on the rear 19 of the lock case, thereby forming a limit for the movement of handle 33 and of longitudinal slides 50, 60. When handle 33 is released, it will return into its initial position I, the follower pin 32 of nut 30 coming to rest on the upper end of the free-running portion 36. The door or window wing is released to be opened and can be pivoted.

Figure 2:
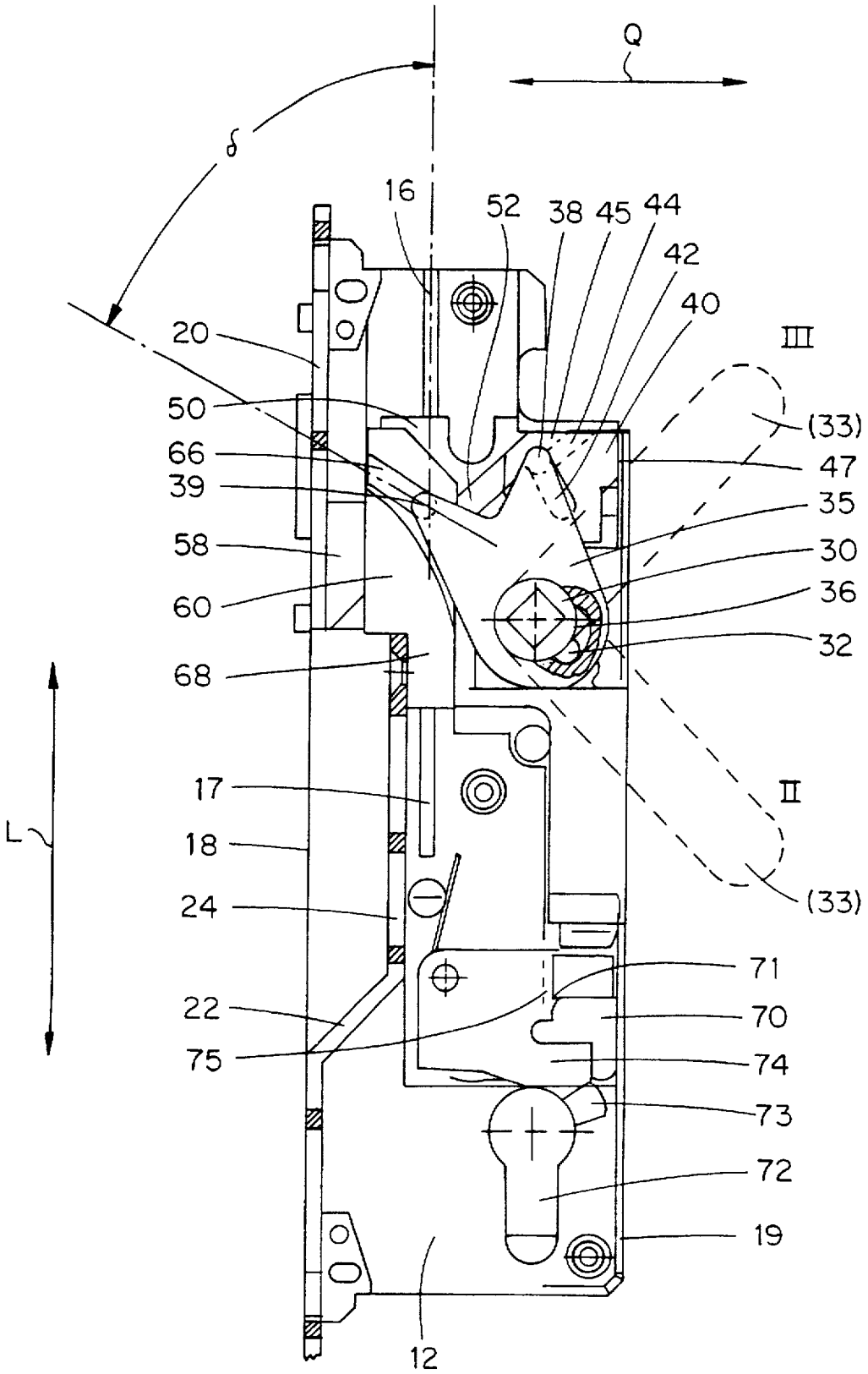
FIG. 2 is a view corresponding to FIG. 1, showing the mechanism with retracted push rods.

To lock the wing, handle 33 is Just pivoted upwards into position III (FIG. 2). The motion sequence described for the opening process is reversed, i.e. claw 38 of the nut sleeve 35 moves the transverse slide 40 leftwards up to its stop and thus the upper longitudinal slide 50 upwards whereas the second claw 39 pushes the lower longitudinal slide 60 downwards at the same time. The push rods 20, 22 and thus the locking bolts move again into their closing position. The door or window wing is latched in closed position.

To prevent any unauthorized operation of the drive-rod type drive mechanism 10 in the extended state of push rods 20, 22, there is provided a lock bolt 70 which in the locking position can engage into a recess 24 of the lower push rod 22. Since all movable components are force-coupled with one another, the entire drive mechanism is thus blocked. Bolt 70 is operated via a locking cylinder 72, with a spring-loaded pivotably supported rocker 74 locking the bolt 70 in its end positions. In the opened position (FIG. 2) a plate 75 bent at right angles on the rocker 74 engages in a locking recess 71 in lock bolt 70, whereas the plate 75 grips behind bolt 70 in the locking position (FIG. 1). The plate 75 thus forms a releasable detent that is operative to lock said bolt in both the opened and the locking positions thereof.

The present invention is not restricted to the above-described embodiment, but can be modified in many ways. For instance, at least one of grooves 42, 66 may be formed as a bent or curved path in the transverse slide 40 or the lower longitudinal slide 60 so that the corresponding claw 38, 49 moves into a locking position when the push rods 20, 22 are extended. Unauthorized operation of the lock via the locking bolts at the ends of the push rods 20, 22 is excluded by self-locking provided by simple means. To prevent any inadvertent extension of position of the locking bolts from their retracted positions when the wing is being pivoted, and e.g. damage to the floor by the bolts, it may be expedient to lock the push rods 20, 22 and/or the longitudinal slides 50, 60 in their end positions, e.g. by means of a slide nose-loaded ball. Where desired, the transverse slide 40 can additionally assume a locking function.

As can be seen, a drive-bolt drive mechanism 10 for door, gate or window wings comprising a lock case 11, at least one handle lever 33 pivotably supported in a lock nut 30, and two oppositely driven push rods 20, 22 which are supported in a longitudinally movable manner, includes longitudinally and/or transversely movably supported follower elements 40, 50, 60 in order to couple the movement of the push rods with the operation of the handle lever 33. To this end the present invention makes use of a lower longitudinal slide 60 which is driven via a groove 66 and a claw 39 by the follower 35. The latter co-operates with the lock nut 30 via a free-running recessed portion 36. The upper longitudinal slide 50 with groove 52 is indirectly driven from the transverse slide 40 by a slide nose 45 of the transverse slide 40 running in the groove 52 of the upper slide 50. The transverse slide itself is driven by the second claw 38 of the follower which is guided in the oblique groove 42 of the transverse slide 40. The longitudinal slides 50, 60 are coupled with the push rods 20, 22, so that a pivotal movement of handle 33 entails an opposite movement of the push rods.

All features and advantages which become apparent from the claims, the description and the drawing, including constructional details, spatial arrangements and process steps, can be considered to form details of the invention whether taken individually or combined in different ways.

What we claim is:

1. A drive-bolt drive mechanism (10) for doors, gates, windows comprising:

a lock case (11);

at least one handle lever (33) pivotably supported in a lock nut (30) in said lock case;

two oppositely driven push rods (20, 22) which are supported in a longitudinally movable manner in said lock case, said push rods (20, 22) being coupled for actuation by said handle lever (33) via follower elements that are movably supported in said lock case;

two longitudinal slides (50, 60) guided in respective longitudinal first and second grooves (16, 17) and a transverse slide (40) guided in a transverse groove (14), wherein a first of said two longitudinal slides (60) is in direct engagement with follower means (32, 35) which are pivotably supported, and a second of said two longitudinal slides (50) is in indirect engagement with said follower means (32, 35) through said transverse slide (40), and said follower means (32, 35) are coupled to be moved by said handle lever (33) upon pivotal movement of said handle lever.

2. The drive mechanism according to claim 1, wherein one of said push rods (20, 22) is coupled to said first longitudinal slide (60).

3. The drive mechanism according to claim 2, wherein a second of said push rods (20, 22) is coupled to said second longitudinal slide (50).

4. The drive mechanism according to claim 1, wherein said follower means (32, 35) includes said lock nut (30) which has a lateral follower pin (32) thereon.

5. The drive mechanism according to claim 4, wherein said follower means (32, 35) includes a nut sleeve (35) which encloses said lock nut (30) and has a free-running portion (36) in which said lateral follower pin (32) is received.

6. The drive mechanism according to claim 5, wherein said nut sleeve (35) comprises a claw (38) which engages in a fourth groove (66) in said first longitudinal slide (60).

7. The drive mechanism according to claim 6, wherein said fourth groove (66) is oriented at an angle ($\delta$) oblique to a direction of movement (L) of said first longitudinal slide (60).

8. The drive mechanism according to claim 5, wherein said nut sleeve (35) comprises a claw (39) which engages in a groove (42) in said transverse slide (40), said transverse slide (40) being supported in a transversely displaceable manner above said lock nut (30).

9. The drive mechanism according to claim 6, wherein said nut sleeve (35) has a second claw (39) which engages in a fifth groove (42) in said transverse slide (40), said transverse slide (40) being supported in a transversely displaceable manner above said lock nut (30).

10. The drive mechanism according to claim 9, wherein said fifth groove (42) is oriented at an angle ($\alpha$) oblique to a direction of movement (Q) of said transverse slide (40).

11. The drive mechanism according to claim 9, wherein said transverse slide (40) comprises a slide nose (45) which engages in a sixth groove (52) in said second longitudinal slide (50).

12. The drive mechanism according to claim 11, wherein said sixth groove (52) is oriented at an angle ($\beta$) oblique to a direction of motion (L) of said second longitudinal slide (50).

13. The drive mechanism according to claim 12, wherein said angle ($\beta$) is approximately 45°.

14. The drive mechanism according to claim 9, wherein said fourth and fifth grooves (66, 32) are straight.

15. The drive mechanism according to claim 6, wherein said fourth groove (66) is straight.

16. The drive mechanism according to claim 1, wherein one of said push rods (20, 22) is coupled to said second longitudinal slide (50).

17. The drive mechanism according to claim 1, including a locking mechanism (70, 72) operable to effect locking of said push rods (20, 22) in limiting end positions thereof.

18. The drive mechanism according to claim 1, wherein at least one of said push rods (20, 22) is lockable by means of a closing element comprising a lock bolt (70).

19. The drive mechanism according to claim 18, wherein said lock bolt (70) is operable via a lock cylinder (72).

* * * * *

UNITED STATES PATENT AND TRADEMARK OFFICE

CERTIFICATE OF CORRECTION

PATENT NO. : 5,752,727

DATED : May 19, 1998

INVENTOR(S) : Christian Zeus; Heinz-Eckhard Engel

It is certified that error appears in the above-indentified patent and that said Letters Patent is hereby corrected as shown below: On the title page:

Item: [75]

Change "Zues" to --Zeus-- and "Stilff" to --Stilfs--

Item: [30]

Change "295 13 277 U" to --295 13 277.2--

Signed and Sealed this

Seventh Day of September, 1999

*Attest:*

Q. TODD DICKINSON

*Attesting Officer*

*Acting Commissioner of Patents and Trademarks*